US010518946B2

(12) United States Patent
Bloc et al.

(10) Patent No.: US 10,518,946 B2
(45) Date of Patent: Dec. 31, 2019

(54) HEAD FOR DISPENSING A PRODUCT COMING FROM A CONTAINER

(71) Applicant: ALBEA SERVICES, Gennevilliers (FR)

(72) Inventors: Richard Bloc, Derchigny-Graincourt (FR); Thomas Pruvost, Saint Quentin la Motte (FR)

(73) Assignee: ALBEA SERVICES, Gennevilliers (FR)

( * ) Notice: Subject to any disclaimer, the term of this patent is extended or adjusted under 35 U.S.C. 154(b) by 59 days.

(21) Appl. No.: 16/038,135

(22) Filed: Jul. 17, 2018

(65) Prior Publication Data

US 2019/0016509 A1 Jan. 17, 2019

(30) Foreign Application Priority Data

Jul. 17, 2017 (FR) ..... 17 56768

(51) Int. Cl.

| | |
|---|---|
| ***B65D 47/20*** | (2006.01) |
| ***B05B 11/04*** | (2006.01) |
| ***B05B 11/00*** | (2006.01) |
| ***B65D 83/14*** | (2006.01) |

(52) U.S. Cl.

CPC ..... *B65D 47/2068* (2013.01); *B05B 11/007* (2013.01); *B05B 11/0064* (2013.01); *B05B 11/0072* (2013.01); *B05B 11/047* (2013.01); *B05B 11/3061* (2013.01); *B65D 83/7535* (2013.01)

(58) Field of Classification Search

CPC ..... B65D 47/2068; B65D 83/7535; B05B 11/0064; B05B 11/007; B05B 11/0072; B05B 11/047; B05B 11/3061

USPC ..... 239/337, 343, 438, 452, 533.1, 533.13; 222/321.6, 321.7, 394, 402.1, 491

See application file for complete search history.

(56) References Cited

U.S. PATENT DOCUMENTS

| | | | | |
|---|---|---|---|---|
| 3,437,270 | A * | 4/1969 | Venus, Jr. | B05B 1/3457 222/402.1 |
| 4,182,496 | A * | 1/1980 | Burke | B05B 1/3436 222/394 |
| 5,819,990 | A | 10/1998 | Cimentepe et al. | |
| 6,412,665 | B1 | 7/2002 | Taghavi-Khanghah | |
| 6,443,370 | B1 * | 9/2002 | Brulle | B05B 1/3436 239/333 |
| 6,543,703 | B2 * | 4/2003 | Blake | B05B 1/3436 239/533.13 |
| 6,609,666 | B1 * | 8/2003 | Blake | B05B 1/3436 239/337 |

(Continued)

FOREIGN PATENT DOCUMENTS

| | | |
|---|---|---|
| FR | 2524348 | 10/1983 |
| FR | 2767311 | 2/1999 |

*Primary Examiner* — Steven J Ganey

(74) *Attorney, Agent, or Firm* — Steven M. Greenberg, Esq.; Shutts & Bowen LLP

(57) ABSTRACT

A dispensing head for a system for dispensing a product is described herein. The head includes a body having a housing that is provided with an anvil around which a nozzle is mounted. The nozzle includes an outlet orifice to place the housing in communication with the exterior, and wherein the head includes a membrane added around the periphery of the anvil in the housing in such a way as to form between the membrane and the nozzle a path for dispensing the product.

12 Claims, 3 Drawing Sheets

(56) References Cited

U.S. PATENT DOCUMENTS

| | | | | |
|---|---|---|---|---|
| 7,721,978 | B2 * | 5/2010 | Chevalier | B05B 11/0072 222/494 |
| 2016/0016722 | A1 | 1/2016 | Bloc | |

* cited by examiner

HEAD FOR DISPENSING A PRODUCT COMING FROM A CONTAINER

CROSS-REFERENCE TO RELATED APPLICATIONS

This application claims priority under 35 U.S.C. 119(a) to French Patent Application No. 1756768, filed Jul. 17, 2017.

BACKGROUND OF THE INVENTION

Field of the Invention

The invention relates to a dispensing head for a system for dispensing a product, and more precisely, to a dispensing head for a dispensing system including such a head fixed on a pressurized feed tube of the product as well as a bottle intended to contain a product to be dispensed.

Description of the Related Art

In a particular application, the product is of the lotion, gel or cream type, for example for a use in cosmetics or for pharmaceutical treatments. Dispensing systems are known including a pump provided with a pressurized feed tube of the product whereon a dispensing head of the push-button type is fixed in order to actuate the displacement of the tube of a dispensing/suction stroke of the product.

In particular, the dispensing head can include a body that has a well for mounting the head on the feed tube and a path for dispensing the product between the well and an outlet passage. According to an embodiment, the dispensing path is formed at least partially at the interface between an anvil that is provided on a housing provided in the dispensing head and a nozzle mounted around the anvil. As such, by pressing on the body of the dispensing head, the pump is actuated in order to dispense the product through the outlet passage in the form of a small amount or a continuous flow.

The laws intended to protect the consumer and the environment very strictly regulate the composition of cosmetic and pharmaceutical products. This entails in particular controlling and limiting the presence of substances that are potentially dangerous for human health. As such, cosmetologists limit and even suppress from their formulas the preservatives which are often the cause of allergies or intolerances.

Cosmetic and pharmaceutical products are therefore becoming increasingly fragile. In particular they have difficulty in supporting mechanical or thermal stresses, contact with air (causing for example drying out, oxidation), and are easily contaminated by bacteria, yeasts and molds.

In order to prevent these problems, the manufacturers of devices for dispensing cosmetics and/or pharmaceutical products have developed improved dispensing heads.

A first dispensing head includes a U-shaped sleeve located between the nozzle added on the head and the anvil and arranged on the periphery of the latter. The sleeve and the nozzle form at their interface a dispensing path. The nozzle includes a deformable wall (wall located facing the sleeve). When the pressurised product flows in the dispensing path, the latter deforms the deformable wall while widening the outlet passage in order to allow for the expulsion thereof outwards. Such as dispensing head makes it possible to limit contact of the product with the outside when the dispensing head is not actuated but even so has disadvantages. A nozzle that is deformable as such compromises the dispensing of the product when the latter is put into contact with an outside element such as the hand of the user or a piece of cotton. Under the effect of an external stress due to the hand for example, the nozzle can be prevented from being deformed, blocking the dispensing or at the least seriously hindering it to the detriment of the perceived quality of the device by the consumer. In addition to the practical aspect of dispensing the product (which is at least partially hindered), this is highly detrimental to the brand image of the manufacturer of dispensing devices and of the producer of pharmaceutical and/or cosmetic products.

A second dispensing head includes an insert that is housed in the added nozzle. The insert has the form of a substantially circular part including three pillars intended to fix the insert in the nozzle and between each one of which extends a deformable wall. In the rest position the deformable walls are substantially vertical and located at a distance from the inner wall of the nozzle by substantially closing the dispensing path. In the stressed position i.e. when cosmetic and/or pharmaceutical product compresses the deformable walls of the insert, the latter are displaced frontwards in the direction of displacement of the product and come into contact with the inner wall of the nozzle and through this, enlarge the dispensing path so that the product can be dispensed. Such a dispensing head makes it possible to limit contamination in the rest position, with the deformable walls in vertical position substantially sealing off the dispensing path. However, the manufacturers of dispensing head encounter difficulties. In particular, the insert is a complex part that includes in particular several materials, namely at least two, one for the pillars and the other for the deformable walls. The manufacturers then have difficulties in producing the insert at an industrial rate. Another disadvantage resides in the fragility of the insert. As the deformable walls are of a particularly complex geometry, the latter are fragile and consequently are damaged and do not return to the rest position. The cosmetic and/or pharmaceutical product is then altered by air to the detriment of the consumer and of the quality perceived by the latter. Another disadvantage resides in the fact that such complex deformable walls have difficulty in returning to the rest position, in particular when the product is highly viscous. Another disadvantage of such an insert is that the latter is invisible to the user. The latter then has the unpleasant sensation that the dispensing head is always open.

BRIEF SUMMARY OF THE INVENTION

Firstly, a dispensing head is proposed for a system for dispensing a product wherein the head includes a body having a housing provided with an anvil around which a nozzle is mounted, the nozzle including an outlet orifice in order place the housing in communication with the outside, and wherein the head includes a membrane added around the anvil in the housing in such a way as to form between the membrane and the nozzle a path for dispensing the product which opens into the outlet orifice, with the membrane including a mobile portion, the mobile portion being mobile between a rest position wherein the mobile portion is in contact with the nozzle and a stressed position wherein the mobile portion is compressed by the product, the mobile portion then being located at a distance from the nozzle.

Such a dispensing head allows for:

- better dispensing of the product under the effect of an external stress, in particular when the head is applied on the hand or on a support such as cotton,
- facilitating the manufacture of the dispensing head, in particular with less complex elements, obtaining a dispensing head that has a longer service life.

Other additional characteristics can be provided alone or in combination:

- the mobile portion includes an outer wall and a bulb that extends from the outer wall protruding along a dispensing axis of the housing;
- the bulb includes a chamfer intended to allow an end of the bulb to be inserted into the outlet orifice in such a way that the bulb extends at least partially into the outlet orifice;
- the bulb includes a contact wall that is substantially perpendicular to the dispensing axis, with the contact wall cooperating with an inner wall of the nozzle;
- the contact wall includes a groove;
- the groove extends from a periphery of the contact wall to a peripheral wall of an end of the bulb;
- the membrane is mounted on the anvil in such a way that the outer wall is located at a distance from the anvil forming between the outer wall and the anvil, an outflow area;
- the anvil includes an outflow channel communicating with a recess formed in the body, via an outflow passage;
- the membrane includes an annular protrusion of revolution around the dispensing axis, the annular protrusion including at least one hole passing through the annular protrusion on either side along a direction parallel to the dispensing axis;
- the at least one hole is an integral part of the dispensing path in such a way that the product moving along the dispensing path passes through the at least one hole;
- the membrane is able to provide a microbiocidal action on the product;
- the membrane includes a microbiocidal metal material such as silver, copper, zinc, magnesium, silver oxide, copper oxide, sulphur, sulphonic acid;
- the head includes a well for mounting the head on a pressurised feed tube of the product, with the housing including the anvil and the housing being in communication with the well;
- the membrane is added around the periphery of the anvil;
- the mobile portion is located facing the outlet orifice.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Figure 1:
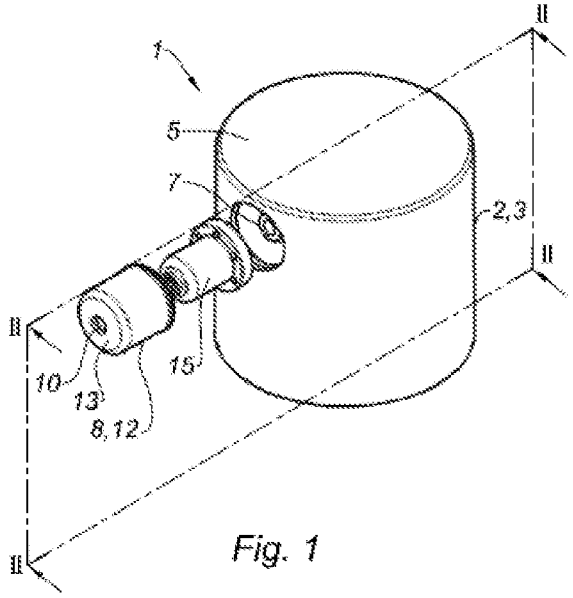
FIG. 1 is an exploded view of the dispensing head according to the invention.

In relation with the figures, a dispensing head 1 of the push-button type is described for a system for dispensing a product under pressure, for example in the form of a small quantity or a continuous flow. In an embodiment, the product is a lotion, a gel or a cream, for a cosmetic use or for pharmaceutical treatments.

The dispensing head 1 includes a body 2 that has an annular skirt 3 that surrounds a well 4 for mounting the head 1 on a pressurised feed tube of the product. Moreover, the dispensing head 1 includes an upper zone 5 that allows the user to exert a finger press on the head 1 in order to displace it axially along a longitudinal axis X.

The dispensing head 1 is intended to be provided on a dispensing system that includes a sampling device provided with a pressurised feed tube of a product to be dispensed, whereon the well 4 for mounting the head 1 is fixed in a sealed manner in order to allow, by axial displacement of the head 1, the displacement of the tube over a dispensing/suction stroke of the product.

The sampling device of the dispensing system can include a manually-actuated pump or, in the case where the product is packaged under pressure, a manually-activated valve. As such, during a manual displacement of the dispensing head 1, the pump or valve is actuated in order to supply the feed tube with pressurised product.

In particular, a manually-actuated pump conventionally includes a body wherein are arranged the means required for pressurising the product to be dispensed. According to a particular embodiment, the pump is of the type without air intake as compensation for the volume of product dispensed, so as to not introduce any contaminant into the packaged product.

In a known manner, the system for dispensing moreover includes means, for example a ring, in order to allow for the mounting thereof on the neck of a bottle wherein a product to be dispensed is intended to be packed, as well as means for feeding the sampling device with packaged product, for example a dip tube arranged in the reservoir or a feed piston slidably mounted in the body of the reservoir in such a way as to push the product in the sampling device.

The body also has an annular housing 6 which is in communication with the mounting well 4. In the embodiment shown, the housing 6 is of an axis perpendicular to that of the mounting well 4 that extends according to the axis X shown in FIG. 2 in order to allow for a lateral dispensing of the product relatively to the body 2. In an alternative not shown, the housing 6 can be collinear to the mounting well 4, in particular for a dispensing head forming a dispensing nose endpiece. In what follows the axis of the housing is called the dispensing axis D.

The housing is provided with an anvil 7 around which an added nozzle 8 is mounted in such a way as to form at the interface thereof a path 9 for dispensing the product between the housing 6 and an outlet orifice 10 of the product made in the nozzle 8. To do this, the anvil 7 extends from the bottom of the housing by leaving a communication channel 11 between the well 4 and the housing 6.

As such, by fixing the mounting well 4 on the feed tube, the dispensing of the product is carried out by pressing on the body 2 in order to actuate the displacement of the tube in order to carry the packaged product from the feed tube to the outlet orifice 10 of the dispensing path 9.

In an alternative embodiment not shown in the figures, the skirt 3 of the body 2 is directly mounted on a reservoir with a flexible body. The body 2 is filled with lotion, which can migrate in the feed channel 11 then the dispensing path 9. In this alternative embodiment, the head does not include a well 4.

The dispensing system can also be used for other types of dispensing. In particular, the reservoir of the bottle can include a flexible body, with the pressurising of the product in the feed tube being carried out by bringing the walls of the reservoir closer together, without using a pump.

In the embodiment shown, the nozzle 8 has a lateral wall 12 of cylindrical revolution which is substantially closed towards the front by a distal wall 13.

The association of the nozzle 8 in the housing 6 is carried out by press-fitting of the outer surface 14 of the lateral wall 12, a rear edge of the outer surface furthermore able to be provided with a radial anchoring protrusion of the nozzle 8 into the housing 6. Advantageously, the nozzle 8 and the body 2 of the dispensing head 1 are carried out by moulding, in particular with a different thermoplastic material.

In particular, at least the lateral wall 12 of the nozzle 8 can be made from a material of which the rigidity is greater than the rigidity of the material that form the body 2. As such, the substantial stiffness of the lateral wall 12 makes it possible to prevent the deformation thereof when it is mounted in the housing 6. Furthermore, the less substantial stiffness of the body 2 allows for an improved seal between the mounting well 4 and the feed tube.

In an embodiment, the nozzle 8 is made with a base of low density polyethylene (LDPE), cyclo olefin copolymer (COC), poly(oxymethylene) or poly(butylene terephthalate), and the body 2 is made from polyolefin.

Between two dispensings, product remains immobilized in the dispensing path 9, putting it into contact with outside air that is potentially contaminated with bacteria and/or mushrooms. As such, via retrodiffusion from the outlet orifice 10 in the dispensing path 9, at least the dose to be dispensed later can be contaminated.

In order to limit this contamination, the dispensing head includes a membrane 15 which is added around the periphery of the anvil 7. The membrane 15 delimits at least one portion of the dispensing path 9. The membrane 15 is able to provide a microbiocidal action on the product contained in the dispensing path 9, in particular by being made from a base of at least one material that has microbiocidal properties.

According to an embodiment, the microbiocidal properties of the material are obtained by contact of the product with a microbiocidal agent, for example by using a metal material such as silver, copper, zinc magnesium, silver oxide, copper oxide, sulphur, sulphonic acid. Other elements can be used.

Advantageously, the membrane 15 is made of a synthetic material for example of the polyolefin type and in particular with a base of polypropylene (PP), thermoplastic elastomer (TPE) and in particular polyethylene (PE) of which at least one surface intended to delimit the dispensing path 9 is metallised.

According to another embodiment, the membrane 15 is made of a synthetic material, for example of the polyolefin type and in particular with a base of polypropylene (PP), thermoplastic elastomer (TPE) and in particular polyethylene (PE), the material being loaded with a microbiocidal agent with a load rate that is sufficient so that the particles of the microbiocidal agent are arranged on the surface in order to be in contact with the product.

The membrane 15 includes an annular protrusion 16 of revolution around the dispensing axis D. The annular protrusion 16 is advantageously located in the vicinity of a distal end 17 of the membrane 15 opposite an outer wall 32. The annular protrusion 16 includes a plurality of holes 18 passing through the latter on either side according to the dispensing axis. The annular protrusion 16 advantageously makes it possible to rigidly attach the membrane 15 in the housing 6. It is housed on a space formed between the nozzle 8 and the body 2, the nozzle 8 abutting on the annular protrusion 16. The annular protrusion 16 furthermore makes it possible to improve the effectiveness of the microbiocidal nature of the membrane. Indeed, the holes 18 are an integral part of the dispensing path 9, the product therefore passes through the holes 18 in the direction of the outlet orifice 10.

On the opposite, the membrane 15 includes a mobile portion 19 located facing the outlet orifice 10. The mobile portion 19 is mobile between a rest position wherein the latter is in contact with the nozzle 8 such as shown in FIG. 2 and a stressed position wherein the latter is compressed by the cosmetic and/or pharmaceutical product, the mobile portion 19 is then located at a distance from the nozzle 8 such as shown in FIG. 3.

Figure 2:
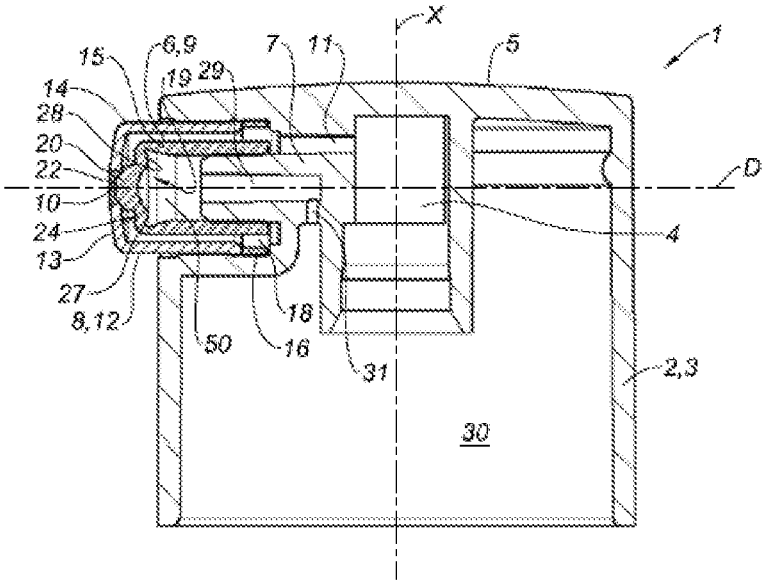
FIG. 2 is a cross-section view according to plane II-II when the dispensing head is assembled and in the rest position.
Figure 3:
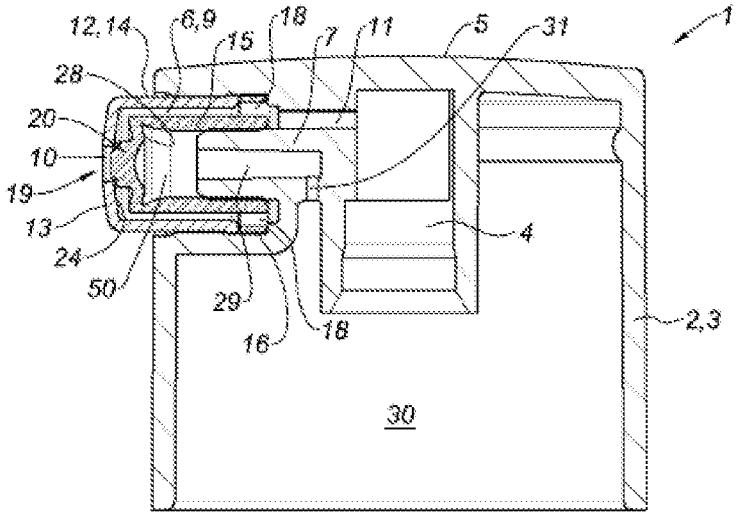
FIG. 3 is a cross-section view identical to FIG. 2 when the dispensing head is in the stressed position.
Figure 4:
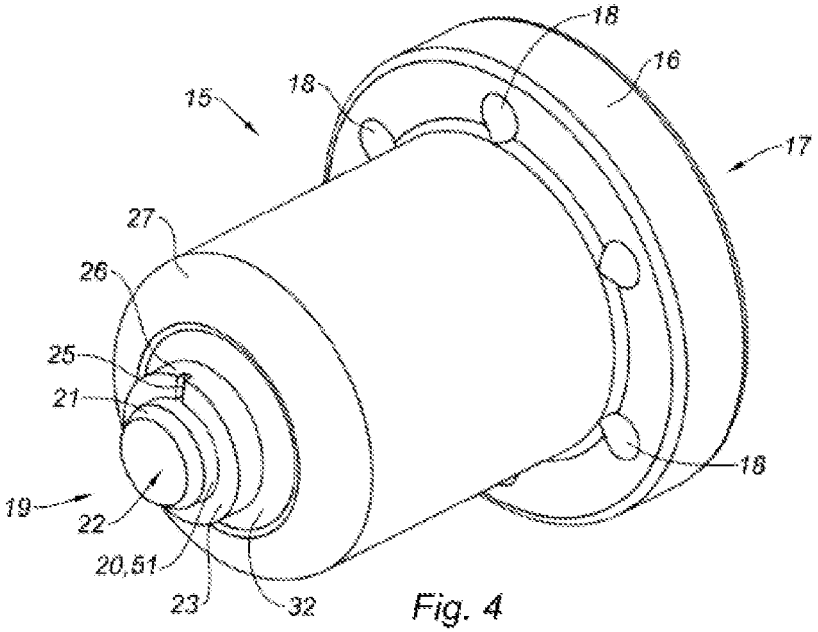
FIG. 4 is a perspective view of a membrane of the dispensing head.

In FIG. 2 the mobile portion 19 extends according to a direction substantially perpendicular to the dispensing axis D.

The mobile portion 19 includes the outer wall 32 and a bulb 20. The bulb 20 extends from the outer wall 32 protruding according to the dispensing axis D. The bulb 20 has a chamfer 21 which is used for mounting the membrane 15 with introduction of the bulb 20 inside the outlet orifice 10. The chamfer 21 is intended to allow an end 22 of the bulb to be inserted into the outlet orifice 10 in such a way that the bulb 20 extends at least partially into the outlet orifice 10. However, the bulb 20 does not extend beyond the outlet orifice 10 and consequently does not extend beyond the outside of the nozzle 8. As shown in FIG. 2, the bulb 20 seals off the outlet orifice 10 from the nozzle 4. In particular, the bulb 20 includes a contact wall 23 substantially perpendicular to the dispensing axis D. The contact wall 23 has a surface that cooperates with an inner wall 24 of the nozzle 8 all around the outlet orifice 10. Advantageously the contact wall 23 includes a groove 25. In the embodiment shown, the groove 25 extends from a periphery 26 of the contact wall 23 to a peripheral wall 51 of the end 22 of the bulb 20.

Figure 5:
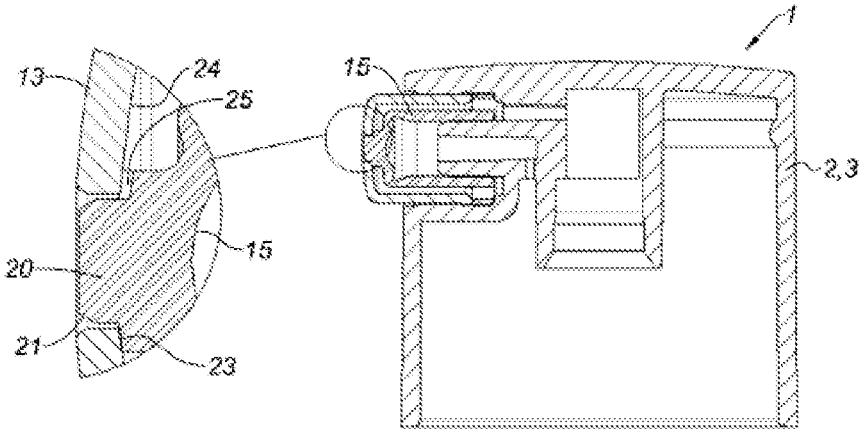
FIG. 5 is another cross-section view of the dispensing head with a zoom showing the interaction of the bulb and of the nozzle in the rest position.
Figure 6:
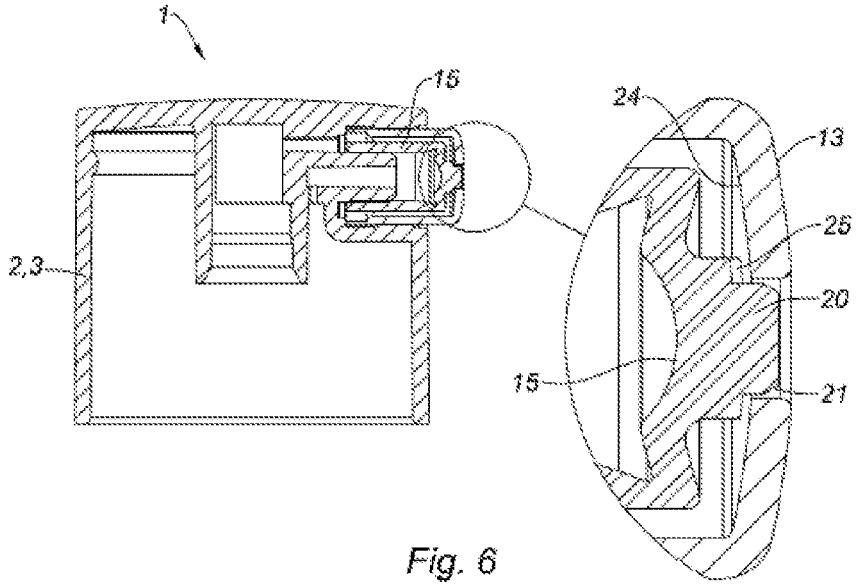
FIG. 6 is another cross-section view identical to FIG. 3 when the dispensing head is in the stressed position.

Initially, a bottle is filled with product, then the pump unit is mounted on the bottle by imprisoning air. The air must then be ejected during the first actuations of the button, this is the priming step. The air, contrary to the product, is not able to displace the membrane. The groove 25 advantageously makes it possible to evacuate the air during the step of priming. When the mobile portion 19 is in rest position, the groove 25 etched in the contact wall 23 allows for permanent communication between the dispensing path 9 and the outlet orifice 10 as shown in FIG. 5. In this way, the air imprisoned in the bottle can be expulsed outwards when the dispensing head 1 is actuated. Indeed without this stream of air, dispensing the product would be made difficult.

The movement of the mobile portion 19 is made possible thanks to the particular shape of the latter. In the embodiment shown in the figures, the mobile portion 19 is connected to the rest of the membrane 15 by a rounded edge 27. On an inner surface 28 in the vicinity of the rounded edge 27, the thickness is reduced with respect to the rest of the membrane 15. In addition, the inner surface 28 is folded abruptly in such a way as to form the spring of the mobile portion 19.

The inner surface, in the vicinity of the bulb, forms a concavity turned towards the anvil. This concavity makes it possible to increase the flexibility of the membrane 15 and also facilitates the unmolding of the latter.

The anvil 7 includes an outflow channel 29. In the embodiment shown in the figures, the outflow channel 29 extends according to the dispensing direction but could nevertheless extend according to any other direction whatsoever. The outflow channel 29 communicates with a recess 30 formed by the annular skirt 3 of the dispensing head 1 via an outflow passage 31. The outflow channel 29 communicates with an outflow area 50 located between the mobile portion 19 and the anvil 7 according to the direction of displacement of the product. The outflow area 50 is located between the anvil 7 and the membrane 15.

Such an outflow area 50 communicating with an outflow channel 29 advantageously allows the mobile portion 19 to be displaced from its rest position to its stressed position without difficulty. Indeed when the mobile portion 19 is displaced to its position stressed, the inner surface 28 compresses the air which is located in the outflow area 29. The compressed air is evacuated to the recess 30 by passing successively through the outflow channel 29 and the outflow passage 31. The movement of the mobile portion 19 is therefore not hindered. When the mobile portion 19 returns to the rest position, it causes a suction that draws the air again to the outflow area 50 via successively the outflow passage 31 and the outflow channel 29.

The outflow area 50 must also allow for the movement of the mobile portion 19. As such the membrane 15 is mounted on the anvil 7 in such a way that the length of the outflow area 50 according to the dispensing axis D is at least greater than the displacement of the mobile portion 19 between its two positions.

When the cosmetic and/or pharmaceutical product is pressurized, the fluid compresses the wall 32 causing the displacement of the mobile portion 19. The displacement of the mobile portion 19 makes it possible to move the contact wall 23 away from the inner wall 24 in such a way that the walls 23, 24 are no longer in contact when the wall 32 is compressed by the fluid.

The dispensing head 1 described hereinabove has many advantages among which:

- a better dispensing of the product in constraining conditions in particular when the head is applied on the hand or on a support such as cotton,
- facilitating the manufacture of the dispensing head, in particular with less complex elements,
- obtaining a dispensing head that has a longer service life: in particular in the case of a highly viscous product,
- the nozzle of the membrane being flush with the outlet orifice, the user has the pleasant sensation that the product is protected for any contamination.

Of note, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description; but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

What is claimed is:

1. A dispensing head for a system for dispensing a product, comprising:

a body having a housing provided with an anvil around which a nozzle is mounted, said nozzle comprising an outlet orifice to place the housing in communication with the exterior, a membrane added around the anvil in the housing and forming between the membrane and the nozzle a path for dispensing the product which opens into said outlet orifice, the membrane comprising a mobile portion, said mobile portion being mobile between a rest position wherein the mobile portion is in contact with the nozzle and a stressed position wherein the mobile portion is compressed by said product, said mobile portion then being located at a distance from the nozzle, the mobile portion comprising an outer wall and a bulb that extends from the outer wall protruding along a dispensing axis of the housing, said bulb comprising a contact wall substantially perpendicular to the dispensing axis, the contact wall cooperating with an inner wall of the nozzle, the contact wall comprising a groove.

2. The dispensing head according to claim 1, wherein the bulb comprises a chamfer allowing an end of said bulb to be inserted into the outlet orifice so as to extend at least partially into said outlet orifice.

3. The dispensing head according to claim 1, wherein the groove extends from a periphery of the contact wall to a peripheral wall of an end of said bulb.

4. The dispensing head according to claim 1, wherein the membrane is mounted on the anvil so as to locate the outer wall at a distance from said anvil forming, between said outer wall and said anvil, an outflow area.

5. The dispensing head according to claim 4, wherein the anvil comprises an outflow channel communicating with a recess formed in the body, via an outflow passage.

6. The dispensing head according to claim 1, wherein the membrane comprises an annular protrusion of revolution around the dispensing axis, said annular protrusion comprising at least one hole passing through said annular protrusion on either side along a direction parallel to the dispensing axis.

7. The dispensing head according to claim 6, wherein the at least one hole is an integral part of the dispensing path in such a way that the product moving along said dispensing path passes through the at least one hole.

8. The dispensing head according to claim 1, wherein the membrane comprises at least one material providing a microbiocidal action on the product.

9. The dispensing head according to claim 8, wherein the membrane comprises a microbiocidal metal material selected from the group consisting of silver, copper, zinc, magnesium, silver oxide, copper oxide, sulphur, and sulphonic acid.

10. The dispensing head according to claim 1, wherein the latter comprises a well for mounting said head on a pressurized feed tube of the product, the housing comprising the anvil and said housing being in communication with said well.

11. The dispensing head according to claim 1, wherein the membrane is added around the periphery of the anvil.

12. The dispensing head according to claim 1, wherein the mobile portion is located facing the outlet orifice.

* * * * *